United States Patent [19]

Donelson

[11] Patent Number: 5,019,242

[45] Date of Patent: May 28, 1991

[54] PARTICULATE MATERIAL CLEANING APPARATUS

[76] Inventor: Harlan J. Donelson, 3705 Windmill La., Plano, Tex. 75054

[21] Appl. No.: 551,322

[22] Filed: Jul. 12, 1990

[51] Int. Cl.[5] ..... B07B 9/00

[52] U.S. Cl. ..... 209/29; 209/37

[58] Field of Search ..... 209/29, 28, 36, 37, 209/318, 138, 139.1

[56] References Cited

U.S. PATENT DOCUMENTS

| | | | |
|---|---|---|---|
| 284,488 | 9/1883 | Russell | 209/36 |
| 422,212 | 12/1890 | Walter | 209/28 |
| 1,966,988 | 7/1934 | McKenna | 209/37 |
| 2,044,628 | 6/1936 | O'Toole | 209/29 X |

FOREIGN PATENT DOCUMENTS

| | | | |
|---|---|---|---|
| 1928377 | 12/1970 | Fed. Rep. of Germany | 209/28 |

*Primary Examiner*—Donald T. Hajec
*Attorney, Agent, or Firm*—Zarley, McKee, Thomte Voorhees & Sease

[57] ABSTRACT

The invention is comprised of an apparatus for cleaning particulate material, particularly grain, wherein the grain is comprised of relatively heavy whole grain particulates and relatively lightweight fine grain particles and foreign material. An upstanding vertically disposed housing has upper and lower ends with upper and lower vertically spaced hoppers having upper and lower ends mounted therein. Vibrating screen members of a frustoconical shape are mounted on the upper ends of the hoppers. The hoppers are laterally spaced from the housing to create a substantially continuous vertical air conduit from the lower to the upper end of the housing. A centrifugal fan is mounted on the top of the housing to move air upwardly through the air conduit. A second air conduit connects the lower ends of the hoppers and the upper end of the housing, and is operable so that suction is imposed by the fan on the second air conduit. A means is provided for supplying particulate grain on the screen member on the upper hopper. An exit port is provided on the upper end of the housing. Whole grain particles move downwardly over the screen member on the upper hopper, fenced downwardly around the upper hopper to the screen member on the lower hopper, and then downwardly around the lower hopper to the lower end of the housing. A grain discharge means is mounted at the lower end of the housing. The fan pulls the fine material upwardly through the air conduits to the exit port.

10 Claims, 1 Drawing Sheet

PARTICULATE MATERIAL CLEANING APPARATUS

BACKGROUND OF THE INVENTION

The cleaning of particulate material, especially in the grain art, is commonplace. Harvested grain, for example, typically has whole grain of relatively heavier weight, and foreign material such as husk or weed particles, and broken grain particles, which are of relatively lighter weight. It is desirable to separate the high quality whole grain particles from the broken grain and foreign debris. Various forced air systems imposed on such material have been typical in the industry.

Existing devices for cleaning grain commonly have reduced capacity, or fail to completely segregate the broken grain and foreign debris from the high quality heavier material.

It is therefor a principal object of this invention to provide a particulate material cleaner which will quickly, efficiently and effectively segregate the quality heavier particles from the inferior quality fine material or foreign material of relatively lighter weight.

A further object of this invention is to provide a particulate material cleaner which uses both mechanical and air sieving action.

A still further object of this invention is to provide a particulate material cleaner which will permit the cleaned material residue to be salvaged, contained and reused without the need for additional equipment.

A still further object of this invention is to provide a particulate material cleaner which prevents dust and pollutants from being discharged into the atmosphere.

These and other objects will be apparent to those skilled in the art.

SUMMARY OF THE INVENTION

The invention is comprised of an apparatus for cleaning particulate material, particularly grain, wherein the grain is comprised of relatively heavy whole grain particulates and relatively lightweight fine grain particles and foreign material. An upstanding vertically disposed housing has upper and lower ends with upper and lower vertically spaced hoppers having upper and lower ends mounted within the housing. Screen members of a frusto-conical shape are mounted on the upper ends of the hoppers. Means are provided for vibrating the screen members. The hoppers are laterally spaced from the housing to create a substantially continuous vertical air conduit from the lower to the upper end of the housing.

A centrifugal fan is mounted on the top of the housing to move air upwardly through the air conduit.

A second air conduit connects the lower ends of the hoppers and the upper end of the housing, and is operatively connected to the centrifugal fan so that a suction is imposed by the fan on the second air conduit.

A means is provided for supplying particulate grain to the upper end of the housing for deposit on the screen member on the upper hopper.

An exit port is provided on the upper end of the housing and in communication with the first air conduit and the centrifugal fan whereby whole grain particles will move downwardly over the screen member on the upper hopper, thence downwardly around the upper hopper to the screen member on the lower hopper, and thence downwardly around the lower hopper to the lower end of the housing. A grain discharge means is mounted at the lower end of the housing. The centrifugal fan pulls the fine particulate material upwardly through the air conduits to the exit port.

DESCRIPTION OF THE PREFERRED EMBODIMENT

Figure 1:
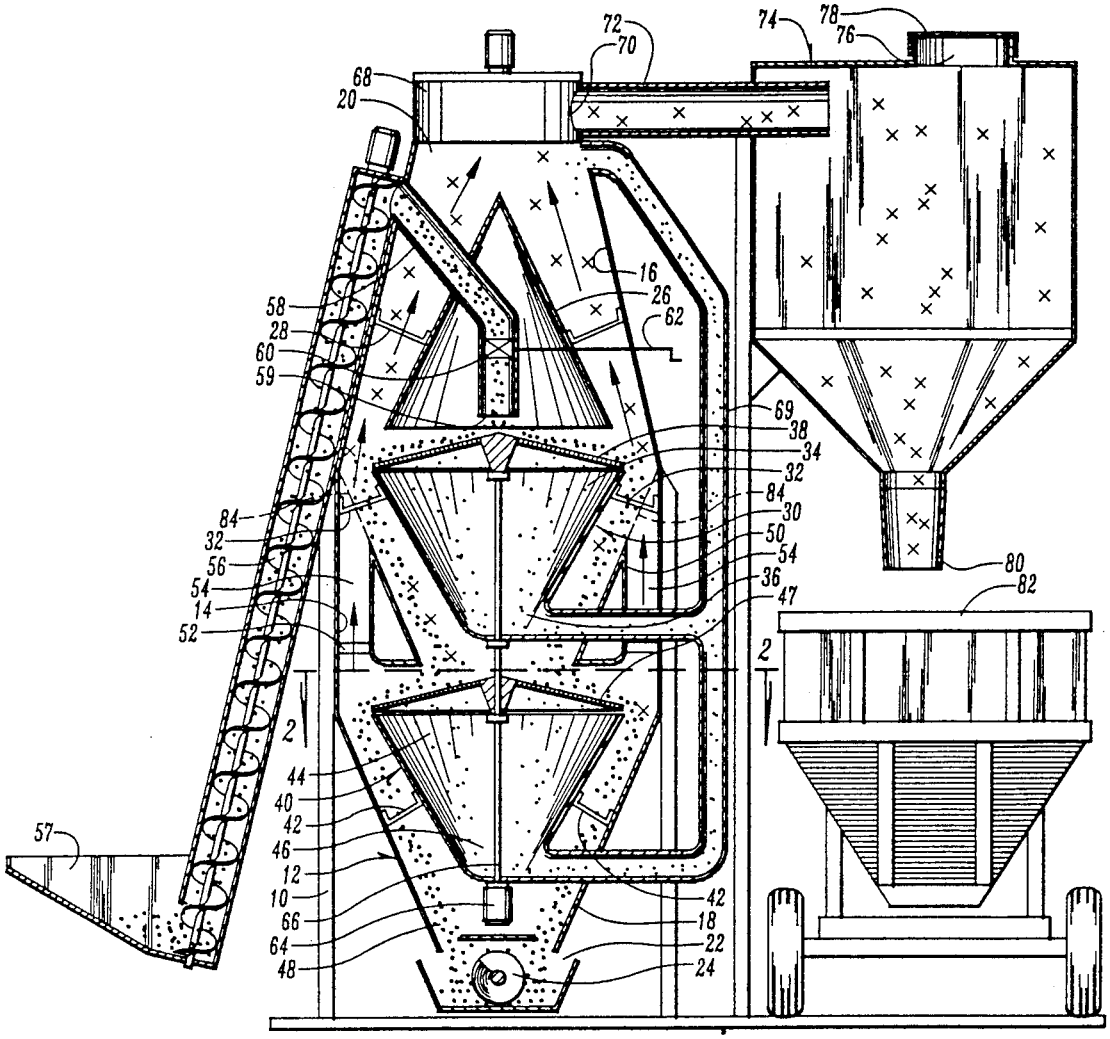
FIG. 1 is a vertical sectional view of the device of this invention.
Figure 2:
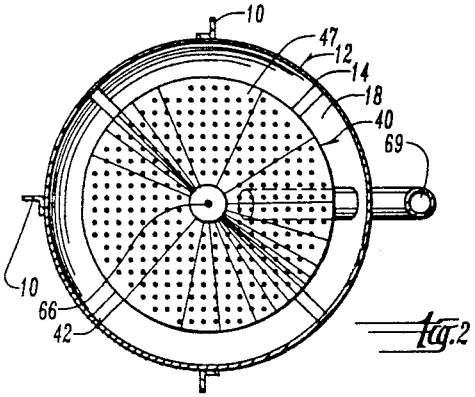
FIG. 2 is a reduced scale horizontal sectional view thereof taken on line 2—2 of FIG. 1.

The numeral 10 designates a frame which supports the vertically disposed housing 12. Housing 12 is comprised of a cylindrical center portion 14, an inverted conical-shaped upper portion 16, and a lower conical shaped lower portion 18. The housing 12 has an open upper end 20 and a lower end 22. A discharge auger means 24 is disposed immediately below the lower end 22 of housing 12.

An inverted conical shaped duct member 26 is mounted in the upper portion 16 of housing 12 by means of spaced brackets 28. An upper hopper 30, which is conically shaped, is positioned in shaped relation directly below duct member 26 by means of brackets 32. Upper hopper 30 is positioned essentially within the cylindrical center portion 14 of the housing. Upper hopper 30 has an upper end 34 and a lower end 36. A frusto-conically shaped screen member 38 is mounted on the upper end 34 of the upper hopper 30.

A lower hopper 40 of the same shape as upper hopper 30 is mounted within housing 12 in the lower portion 18 thereof by means of brackets 42. Lower hopper 40 is vertically spaced below upper hopper 30, and has an upper end 44 and a lower end 46. A screen member 47 identical to screen member 38 is mounted on the upper end 44 of lower hopper 40.

The duct member 26 and the hoppers 30 and 40 are laterally spaced from the side walls of housing 12 to create a first air duct 48. As shown in FIG. 1, tapered duct members 50 are mounted by brackets 52 in spaced relation to the side walls of housing 12 and upper hopper 30 to create an auxiliary duct 54.

A supply auger 56 having hopper 57 at its lower end and a discharge duct 58 at its upper end serves to bring grain or other particulate material upwardly for deposit into the housing. Duct 58 extends through the upper end of housing 12 and extends downwardly through duct member 26 with a discharge end 59 in alignment with the center of upper hopper 30. A valve 60 is imposed in duct 58 and is operated by handle 62 to control the flow of particulate material through the duct.

A vibrating motor of conventional construction is mounted at the lower end of lower hopper 40. Vertical shaft 66 extends upwardly therefrom through the hoppers 30 and 40, and shaft 66 is connected in any convenient manner to the screen members 38 and 47. Motor 64 imposes slight vertical and longitudinal movement to shaft 66 which creates vibrations in the screen members 38 and 47. This vibration motion facilitates the movement of the particulate material over the upper surface of the screens. The screens can be varied in their sifting capabilities. In the case of corn being cleaned in this apparatus, the screen members would prevent whole kernels from passing therethrough, but broken kernels of corn and other fine foreign material would have the ability to pass therethrough into the hoppers 30 and 40.

Centrifugal fan 68 is mounted on the top of housing 12 over open end 20 and is in direct communication with the first air duct 48 and auxiliary duct 54. A second air duct extends from the bottom ends of hoppers 30 and 40 in a lateral direction through the side walls of housing 12, and then extends vertically upwardly for communication with the upper interior end of the housing. Centrifugal fan 68 has an exit port 70 which is connected to horizontal duct 72 which in turn is connected to the top of collection hopper 74. Hopper 74 has an air discharge port 76 over which is mounted a cloth or similar filter 78. A discharge port 80 is located at the bottom of hopper 74. A wagon 82 or the like is mounted below collection hopper 74 to receive the fine material cleaned from the grain.

The normal operation of the device of this invention is as follows: The material to be cleaned, such as newly harvested corn, is introduced into hopper 57 of supply auger 56. The material moves into the discharge duct 58, past valve 60, and is deposited on the upper surface of screen member 38. Motor 64 is started to impart vibration motion to the screens 38 and 47. A centrifugal fan 68 is also in operation at that point in time. The whole kernels of corn are vibrated downwardly and outwardly on screen 38 and move downwardly around upper hopper 30 for deposit on the screen member 47 on lower hopper 40. Screens 84 can be imposed over the upper ends of auxiliary conduits 54 to guide the whole grain material through conduit 48 and to prevent the entry thereof into the auxiliary conduits 54.

At the same time, the fine grain material or lightweight debris passes through screen 38 into hopper 30, and is then pulled outwardly and upwardly in second conduit 69 by the vacuum pull of centrifugal fan 68. This lightweight material is then forced through conduit 72 into collection hopper 74, and thence through port 80 into wagon 82. Any fine and lightweight material on the top of screen member 38 which does not pass through the screen is caught in the upwardly moving draft or vacuum around duct member 26, and is similarly pulled through fan 68.

When the whole kernel material is deposited on the top of the screen member 47 on lower hopper 40, the vibrating screen again moves the whole kernel corn outwardly towards the edge of the screen and thence downwardly around the lower hopper 40. Any fine material which still exists when the corn is deposited on screen 47 has an opportunity to pass through the screen into lower hopper 40, and outwardly and upwardly in conduit 69 as explained heretofore. Also, any fine material which gravitates beyond the outer edge of screen 47 can be pulled upwardly through auxiliary ducts 54 for removal by fan 68 as described earlier.

The material being deposited through duct 58 therefore goes through at least two cleaning operations on the screens 38 and 47 of hoppers 30 and 40, respectively. The whole kernel corn of relatively heavier magnitude is then deposited in the discharge auger means 24 for removal in any desired storage area. All of the lightweight fine particulate material and lightweight debris is pulled upwardly through the various ducts, through fan 68 and duct 72, for deposit in collection hopper 74, and for ultimate deposit in wagon 82. This fine material has feed value, and while it does not have the value of whole kernel corn, it is of economic importance.

It is therefore seen that the device of this invention will achieve at least its stated objectives.

I claim:

1. A grain cleaner, for cleaning particulate grain comprised of relatively heavy whole grain particles, and relatively lightweight fine grain particles and foreign material, comprising, an upstanding vertically disposed housing having upper and lower ends, upper and lower vertically spaced hoppers having upper and lower ends in said housing, screen members on the upper ends of said hoppers, said hoppers being laterally spaced from said housing to create a substantially continuous vertical first air conduit from the lower to the upper end of said housing, fan means to move air upwardly through said first air conduit, a second air conduit means connecting the lower ends of said hoppers and the upper end of said housing, means for supplying particulate grain comprised of relatively heavy whole grain particles, and relatively lightweight fine grain particles and foreign material, to the upper end of said housing for deposit thereof on the screen member on said upper hopper, and an exit port in the upper end of said housing and in communication with said first air conduit, whereby whole grain particles will move downwardly over the screen member on said upper hopper, thence downwardly around said upper hopper to the screen member on said lower hopper, thence downwardly around said lower hopper to the lower end of said housing, with said fan means pulling said fine grain particles and any lightweight foreign particulate material upwardly through said first and second air conduits to said exit port.

2. The device of claim 1 wherein a grain discharge means is mounted at the lower end of said housing.

3. The device of claim 1 wherein a collection hopper is in communication with said exit port, said collection hopper having an air discharge port, and an air filter means on said air discharge port.

4. The device of claim 1 wherein said fan means is positioned at the upper end of said housing.

5. The device of claim 1 wherein vibrating means are connected to said screen members to cause movement of grain particles thereover.

6. The device of claim 1 wherein said screen members have a downwardly and outwardly extending tapered surface.

7. The device of claim 5 wherein said screen members have a downwardly and outwardly extending tapered surface.

8. The device of claim 1 wherein an inverted conical duct member is mounted above said upper hopper.

9. The device of claim 1 wherein said first air conduit has a secondary conduit means to facilitate upper movement of said fine grain particles and foreign material upwardly without interference with downwardly moving whole grain particles.

10. The device of claim 1 wherein said first and second hoppers are conically shaped.

* * * * *